US006079924A

United States Patent [19]

Chiang

[11] Patent Number: 6,079,924

[45] Date of Patent: Jun. 27, 2000

[54] HOLE-PUNCHING AND BINDING APPARATUS FOR PAPERS

[76] Inventor: Jou-Chen Chiang, No. 13, 23 Road, Industrial District, Taichung, Taiwan

[21] Appl. No.: 09/251,878

[22] Filed: Feb. 17, 1999

[30] Foreign Application Priority Data

Jan. 21, 1999 [TW] Taiwan ..... 88201146

[51] Int. Cl.[7] ..... B42B 5/00

[52] U.S. Cl. ..... 412/33; 412/38; 412/39; 412/40; 402/1; 83/618; 83/620; 83/633; 83/684; 83/687; 83/691

[58] Field of Search ..... 412/38, 39, 40; 402/1; 83/618, 620, 633, 684, 687, 691

[56] References Cited

U.S. PATENT DOCUMENTS 3,699,596 10/1972 Lyon ..... 11/1
4,607,993 8/1986 Scharer ..... 412/40

*Primary Examiner*—Willmon Fridie, Jr.
*Assistant Examiner*—Daniel Phan
*Attorney, Agent, or Firm*—Raymond Y. Chan; David and Raymond

[57] ABSTRACT

A hole-punching and binding apparatus for papers includes a hole-punching device drivable to move along a vertical direction. The hole-punching device includes a cutter seat carrying thereon a number of cutters that are equidistantly spaced in a row to punch a row of holes in a stack of papers. Each cutter being freely movable in a row of compartments in the cutter seat so as to optionally follow a hole-punching travel of the cutter seat under control of a slidable shield. A lever-like resilient load-on plate is used to press and thus close open ends of helical coils and to help the user extend the helical coils through a stack of punched papers. The coil-closing device is drivable to move along a horizontal direction. The coil-closing device cooperates with a fixed plate to turn the open ended helical coils into closed ended helical coils.

11 Claims, 11 Drawing Sheets

HOLE-PUNCHING AND BINDING APPARATUS FOR PAPERS

BACKGROUND OF THE INVENTION

1. Field of the Invention

The present invention relates to a hole-punching and binding apparatus for papers, and more particularly to a hole-punching and binding apparatus for papers.

2. Description of the Prior Art

A typical notebook, book, or calendar includes a stack of papers each having a row of equidistantly disposed holes punched in an area adjacent to an edge of every sheet of paper, and a helical coil extends through each one of the row of holes to form a volume. A typical hole-punching/binding device for papers must include functions of punching holes, extending the helical coils through the row of holes, and closing the open end of each helical coil. The hole-punching/binding device has a complicated structure accordingly, and the possibility of malfunction and element wear is high. Maintenance and replacement of worn cutters for punching is particularly difficult. The cutter seat, the driving shaft, and corresponding transmission members often have to be detached before changing the cutter. This results in difficulty in maintenance. In addition, the precision of the device is adversely affected after several times of detachment for maintenance. Thus, the positions of the hole punched might not be precisely located, while the papers cannot be easily bound or turned. In brief, complicated structure, high cost for manufacture, difficult maintenance, and high index of defective products are common disadvantages of all kinds of conventional hole-punching/binding devices for papers.

The present invention is intended to provide an improved hole-punching and binding apparatus that mitigates and/or obviates the above mentioned problems.

SUMMARY OF THE INVENTION

It is a primary object of the present invention to provide a hole-punching and binding apparatus that is simple in structure to lower the manufacture cost and to improve precision of hole-punching and paper binding.

It is another object of the present invention to provide a hole-punching and binding apparatus in which the driving axles and the transmission members need not to be detached for replacing the cutter, thereby providing convenience to maintenance.

It is a further object of the present invention to provide a hole-punching and binding apparatus that can be adapted to bind a stack of papers by means of coils of metal or other material. The hole-punching and binding apparatus in accordance with the present invention has a wider application range and better utility, as it is not limited to the use of plastic coil in the prior art.

It is still another object of the present invention to provide a hole-punching and binding apparatus that includes a device for measuring the thickness of a stack of papers to be bound. In addition, the margin of the holes to be punched are automatically adjusted in response to the thickness of the stack of papers, thereby assuring that each sheet of the paper is turnable after the helical coils are extended through the holes.

It is yet another object of the present invention to provide a hole-punching and binding apparatus, in which any cutter may be independently selected to optionally proceed with or not to proceed with punching, thereby preventing defective products with incomplete holes punched in the edges of the stack of papers. The distance between each two adjacent holes to be punched may be adjusted according to the size of a special volume or the user need.

It is still another object of the present invention to provide a hole-punching and binding apparatus that may measure the open angle of the open ends of the helical coils before closing of the helical coils, thereby adjusting the travel of a press plate that precisely closes the open ends of the helical coils.

A hole-punching and binding apparatus in accordance with the present invention that achieves the above-mentioned objects generally includes:

a casing;

a hole-punching device drivable to move along a vertical direction, the hole-punching device including a cutter seat carrying thereon a plurality of cutters that are equidistantly spaced in a row to punch a row of holes in a stack of papers, the cutter seat being movable in a hole-punching travel, the hole-punching device including a row of compartments, each said cutter being freely movable in the compartments, respectively, a slidable shield being mounted above each said cutter for optionally stopping an associated said cutter to make the associated cutter to move along with the cutter seat during the hole-punching travel of the cutter seat;

a resilient load-on plate acting as a lever, the resilient load-on plate being adapted to retain each of a plurality of open ended helical coils to extend the open ended helical coils through punched holes in the stack of papers, the resilient load-on plate including an end tightly bearing against the stack of papers, and including a paper thickness scale to indicate the thickness of the stack of papers;

a margin-adjusting device including a paper depth-fixing plate that abut against aligned edges of the stack of paper to adjust an entering depth of the stack of papers into the hole-punching device, such that the hole to be punched by each said cutter has a pre-set margin to the aligned edges of the stack of paper;

a coil-closing device drivable to move along a horizontal direction, a fixed plate being secured to the casing, the stack of papers that have been punched being placed between the coil-closing device and the fixed plate so as to be pressed to close an open end of each said open ended helical coil, the coil-closing device further including a projection; and an adjustable baking cam for adjusting a travel of the coil-closing device, the coil-closing device is stopped when the projection of the coil-closing device contacts with the braking cam.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
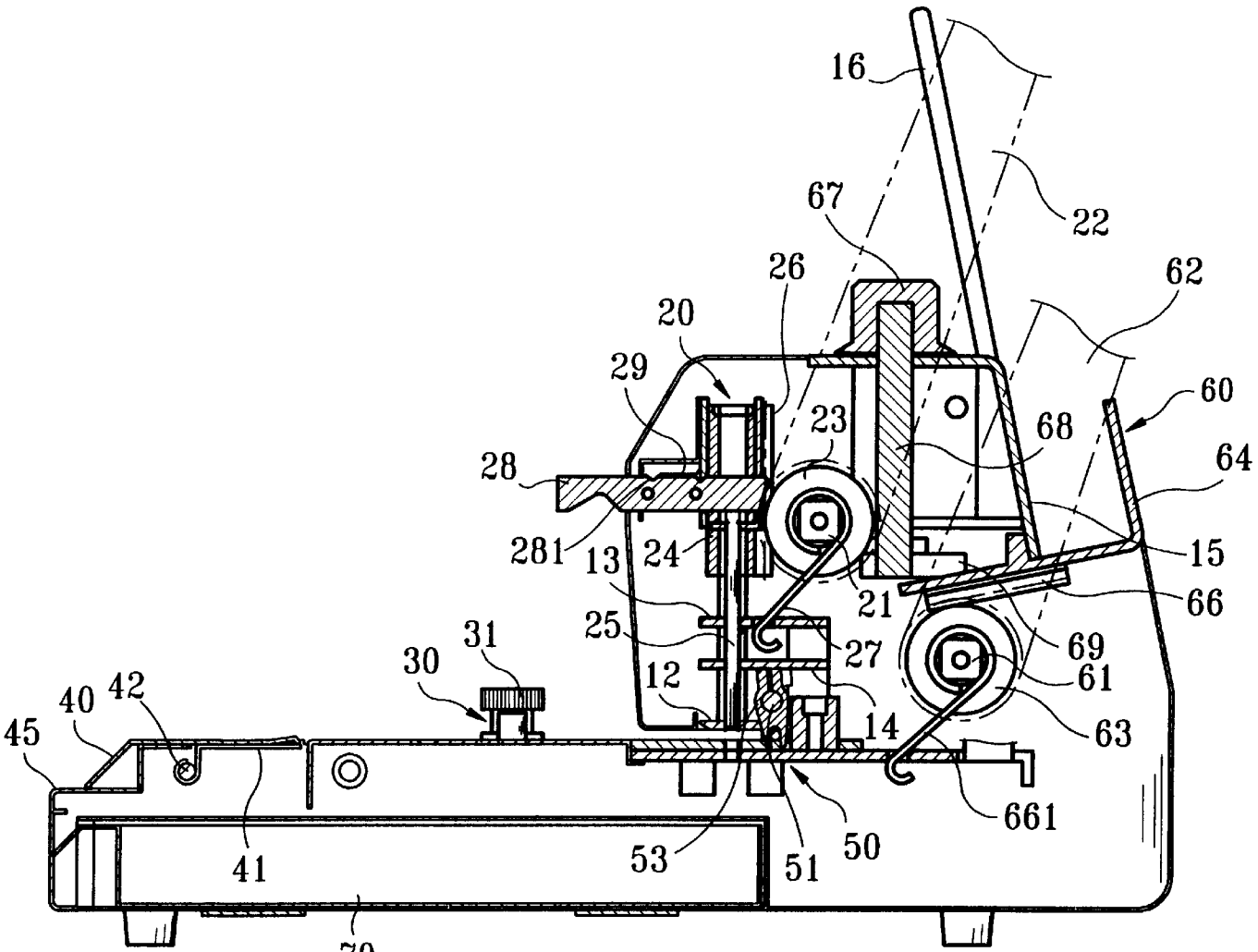
FIG. 1 is a sectional view of a hole-punching and binding apparatus in accordance with the present invention.
Figure 2:
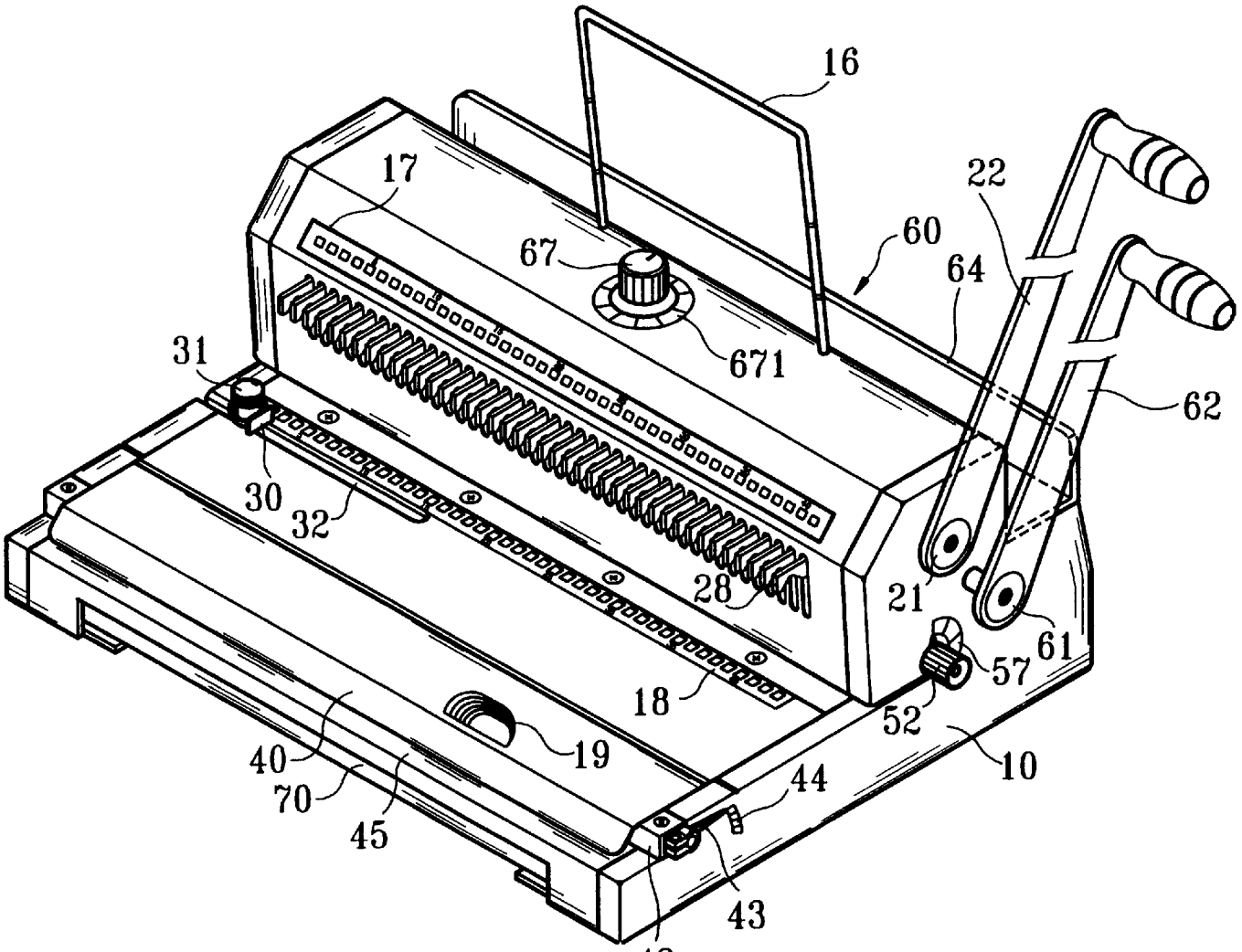
FIG. 2 is a perspective view of the hole-punching and binding apparatus.

Referring to the FIGS. 1 and 2, a hole-punching and binding apparatus in accordance with the present invention generally includes a casing 10; a hole-punching device 20 for punching holes in a stack of papers; a paper width-fixing device 30; a resilient load-on plate 40 for assisting the user in extending open-ended helical coils through the holes punched in the stack of papers; a margin-adjusting device 50 for pre-setting the margin of the holes to be punched to the aligned edges of the stack of papers; a coil-closing device 60 for closing the open ended helical coils to ended helical coils; and a drawer 70 mounted below the casing 10 for collecting paper trash as a result of punching.

When using the hole-punching and binding apparatus in accordance with the present invention to punch holes in a stack of papers 90 and extend helical coils 91 through the punched holes to form a volume, it generally comprises the steps of: measuring the thickness of the stack of papers 90, setting the paper width and the margin of the holes, punching, extending the helical coils 91 through the punched holes, and closing the open ended helical coils 91 to closed ended helical coils 91. These steps will be explained reference to the accompanying drawings.

1. Measuring the thickness of the stack of papers:

As mentioned above, the resilient load-on plate 40 can be used to measure the thickness of the stack of papers 90. Referring to FIGS. 1 and 2, the resilient load-on plate 40 includes a mediate section pivoted to a pivotal axle 42 mounted in a front end of the casing 10 by at least one torsion spring 41, thereby allowing the load-on plate 40 to act as a lever to swivel about the pivotal axle 42 that acts as a fulcrum. The pivotal axle 42 includes an end extended beyond the casing 10. A thickness pointer 43 is attached to the load-on plate 40, and a thickness scale 44 is adhered to the casing 10 to point out the thickness of the stack of papers 90 by the thickness pointer 43.

Figure 4A:
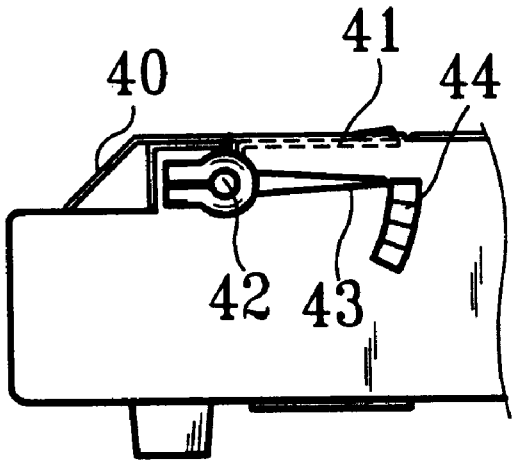
FIG. 4A is a partial side view of the hole-punching and binding apparatus, wherein a resilient load-on plate is not pressed.
Figure 4B:
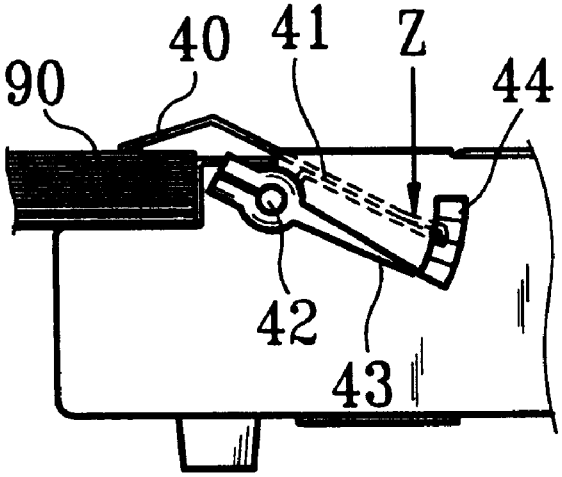
FIG. 4B is a view similar to FIG. 4A, wherein the resilient load-on plate is pressed.

Referring to FIGS. 4A and 4B, when measuring the thickness of a stack of papers 90, the user may press an end (the right one in FIG. 4A) of the load-on plate 40 along a direction indicated by arrow Z. The other end (the left one in FIG. 4B) of the load-on plate 40 is lifted and thus has a distance to a paper-loading platform 45 of the casing 10. A stack of papers 90 is placed on the paper-loading platform 45, and the right end of the load-on plate 40 is released such that the left end of the load-on plate 40 tightly bears against the stack of papers 90 under the action of the torsion spring 41. Thus, the pointer 43 turns together with the load-on plate 40 and indicates the thickness of the stack of papers 90 on by thickness scale 44. The purpose of measuring the thickness of the stack of papers 90 is to use the margin-adjusting device 50 to adjust the pre-set margin of the holes to be punched to the aligned edges of the stack of papers 90. The larger the thickness of the stack of papers, the smaller the pre-set margin. Free pivotal movements of the papers 90 are assured by means of adjusting the pre-set margin.

2. Setting the paper width and the margin of the holes:

As can be seen from FIG. 2, the paper width-fixing device 30 is mounted on the casing 10 and slidable along a guiding slot 32 in casing 10 to reach a position that corresponds to a pre-set paper width. A tightening knob 31 is turned to retain the paper width-fixing device 30 in place. Then, a control knob 52 on the margin-adjusting device 50 is turned to correspond to a margin reference ruler 57 adhered to the casing 10, and a paper depth-retaining plate 54 is moved to a position that corresponds to a pre-set depth. The stack of papers 90 is then moved to a ready-to-punch position below the hole-punching device 20. The aligned lateral edges of the stack of papers 90 abut against the paper width-fixing device 30, while the aligned top edges of the stack of papers 90 abut against the paper depth-fixing plate 54. Thus, the width of the stack of papers to be punched and the margin of the holes to be punched are precisely pre-set.

Figure 3:
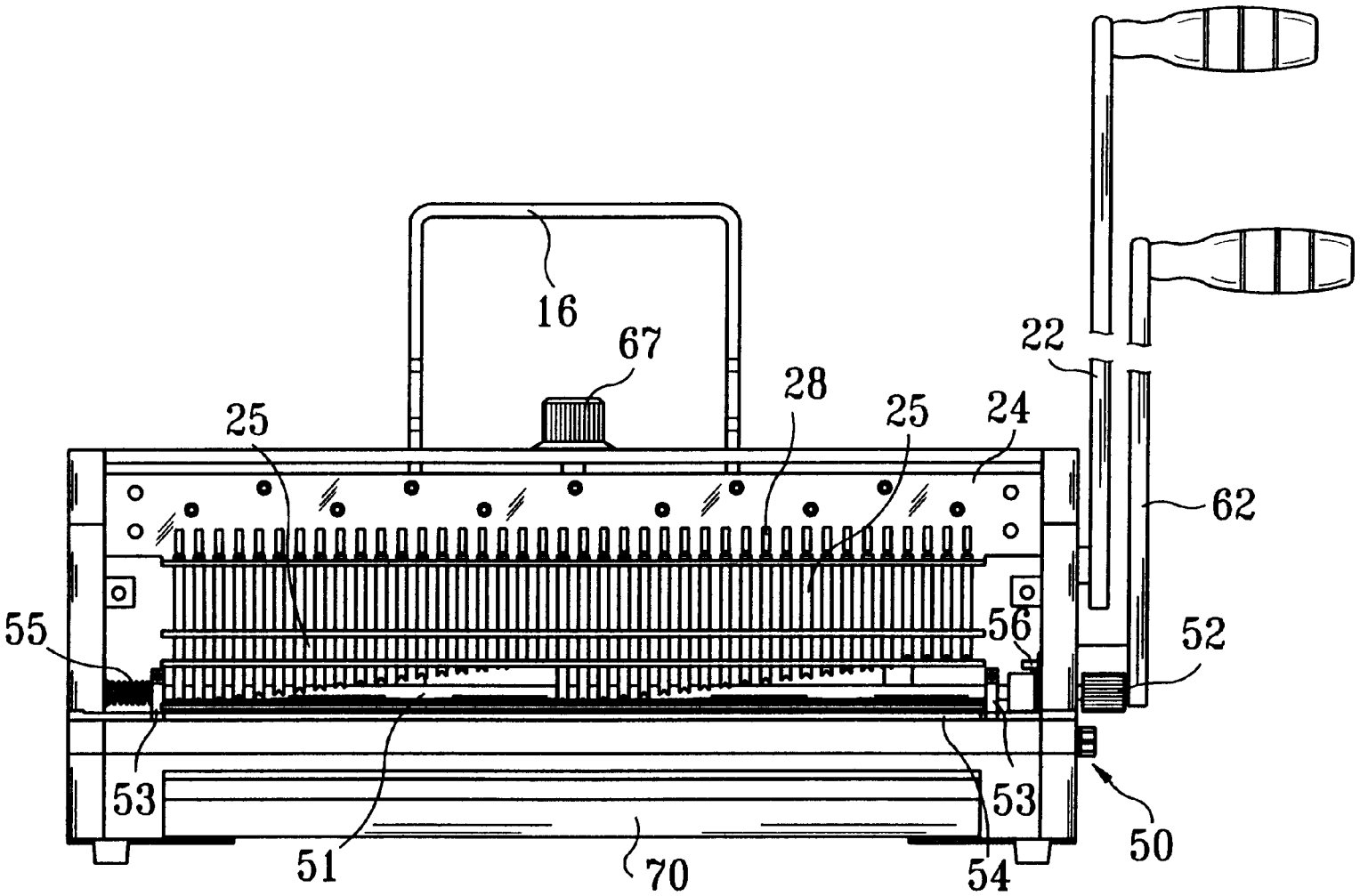
FIG. 3 is a front view of the hole-punching and binding apparatus.
Figure 5A:
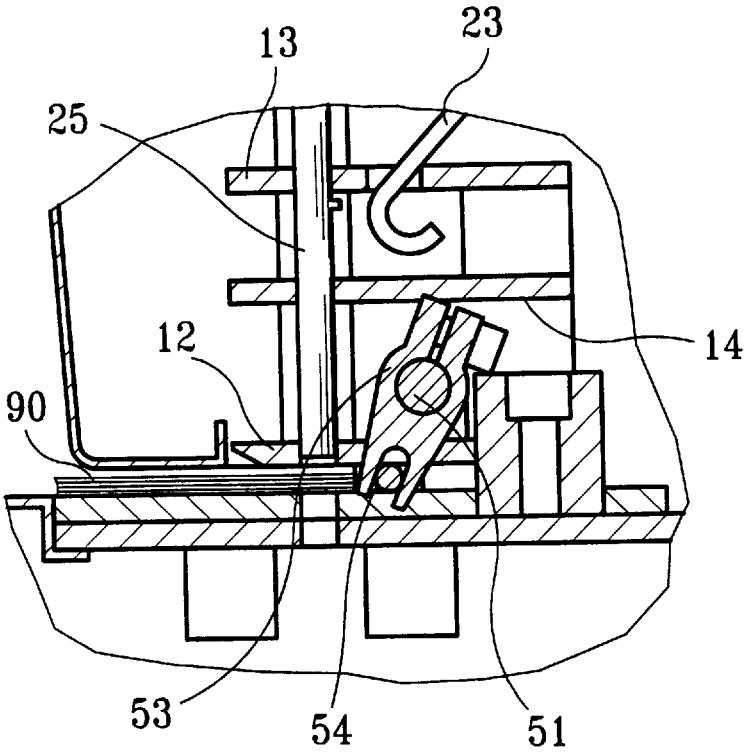
FIG. 5A is an enlarged partial sectional view of the hole-punching and binding apparatus, illustrating a margin-adjusting device.
Figure 5B:
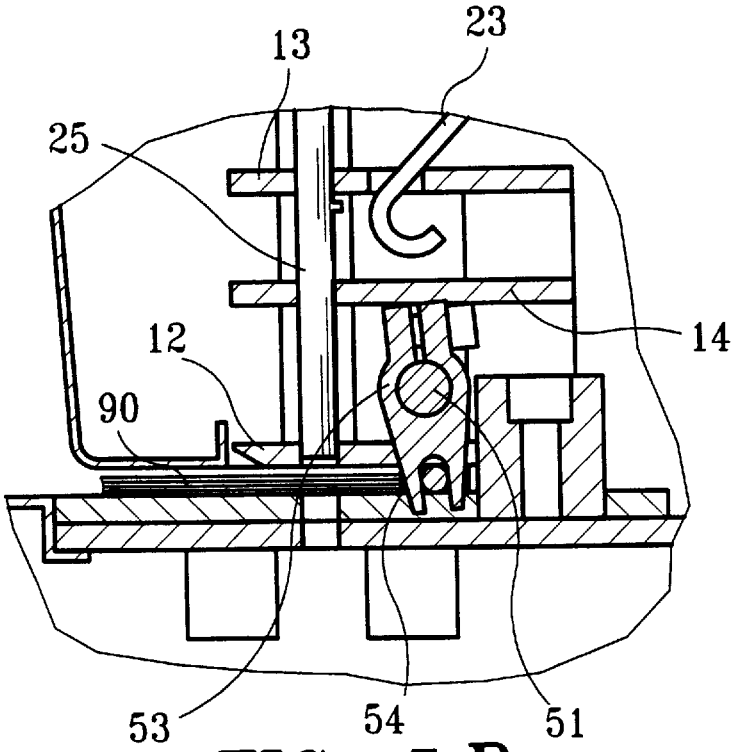
FIG. 5B is a view similar to FIG. 5A, wherein the margin-adjusting device is moved to change the margin of the holes to be punched.

The primary structure of the margin-adjusting device 50 is illustrated in FIG. 3. The margin-adjusting device 50 includes an axle rod 51 that is connected to the control knob 52 to rotate therewith. At least one arm 53 is secured to the axle rod 51 and connected to the paper depth-retaining plate 54. When the axle rod 51 is rotated by means of turning the control knob 52, the paper depth-retaining plate 54 is moved by a proper distance horizontally via actuation of the arm 53, as shown in FIGS. 5A and 5B, thereby setting the margin of the holes to be punched. In addition, a compression spring 55 is mounted around an end of the axle rod 51, while a positioning block 56 is provided on the other end of the axle rod 51. The positioning block 56 is inserted into one of a plurality of positioning holes (not shown) in an inner wall face of the casing 10. The compression spring 55 biases the positioning block 56 toward the positioning holes and thus retains the positioning block 56 in one of the positioning holes.

Figure 6A:
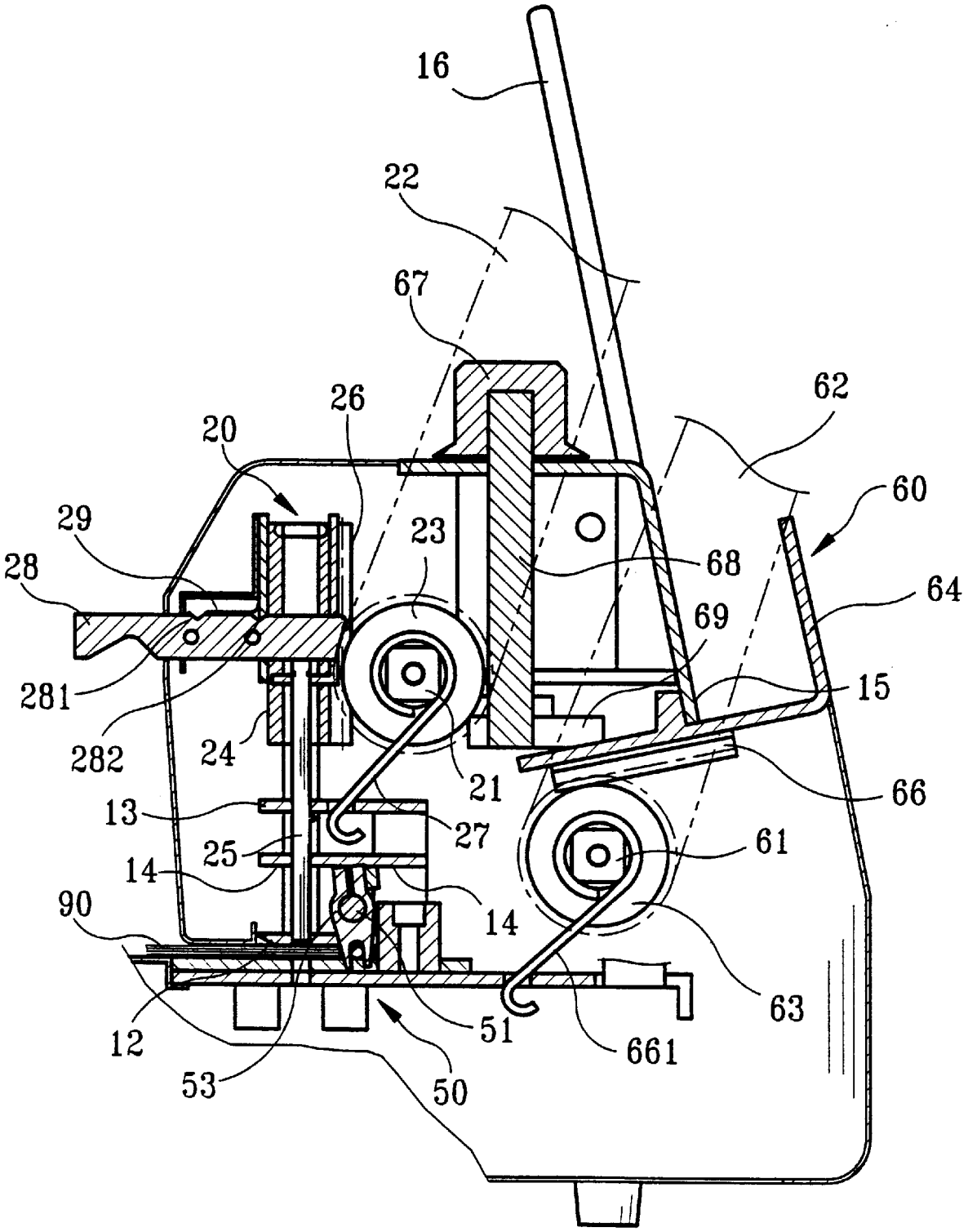
FIGS. 6A to 6C are sectional views of the hole-punching and binding apparatus, illustrating hole-punching in a stack of papers, wherein the papers in FIG. 6A are not punched yet, the papers in FIG. 6B are punched, and the papers in FIG. 6C cannot be punched.
Figure 6B:
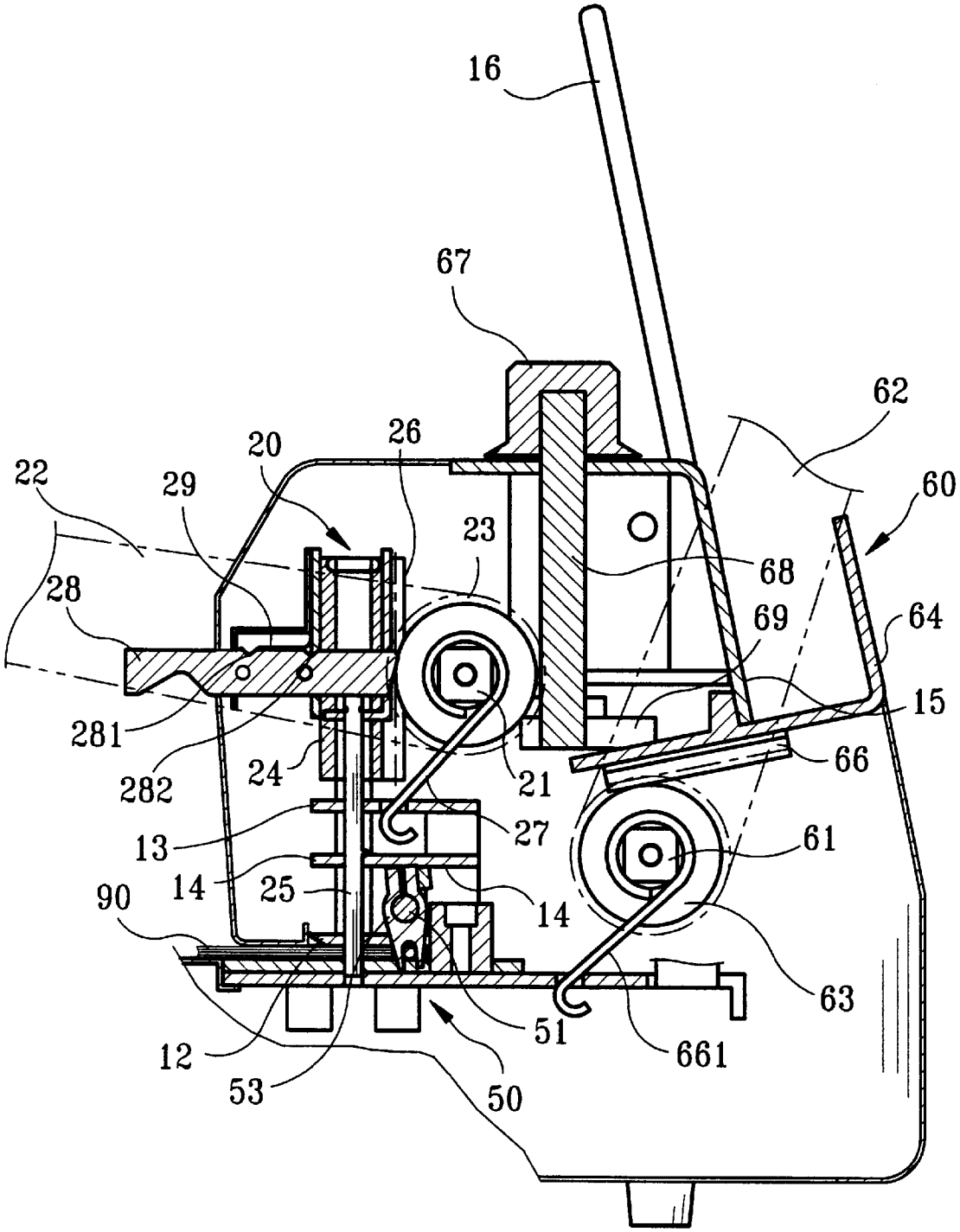
Figure 6C:
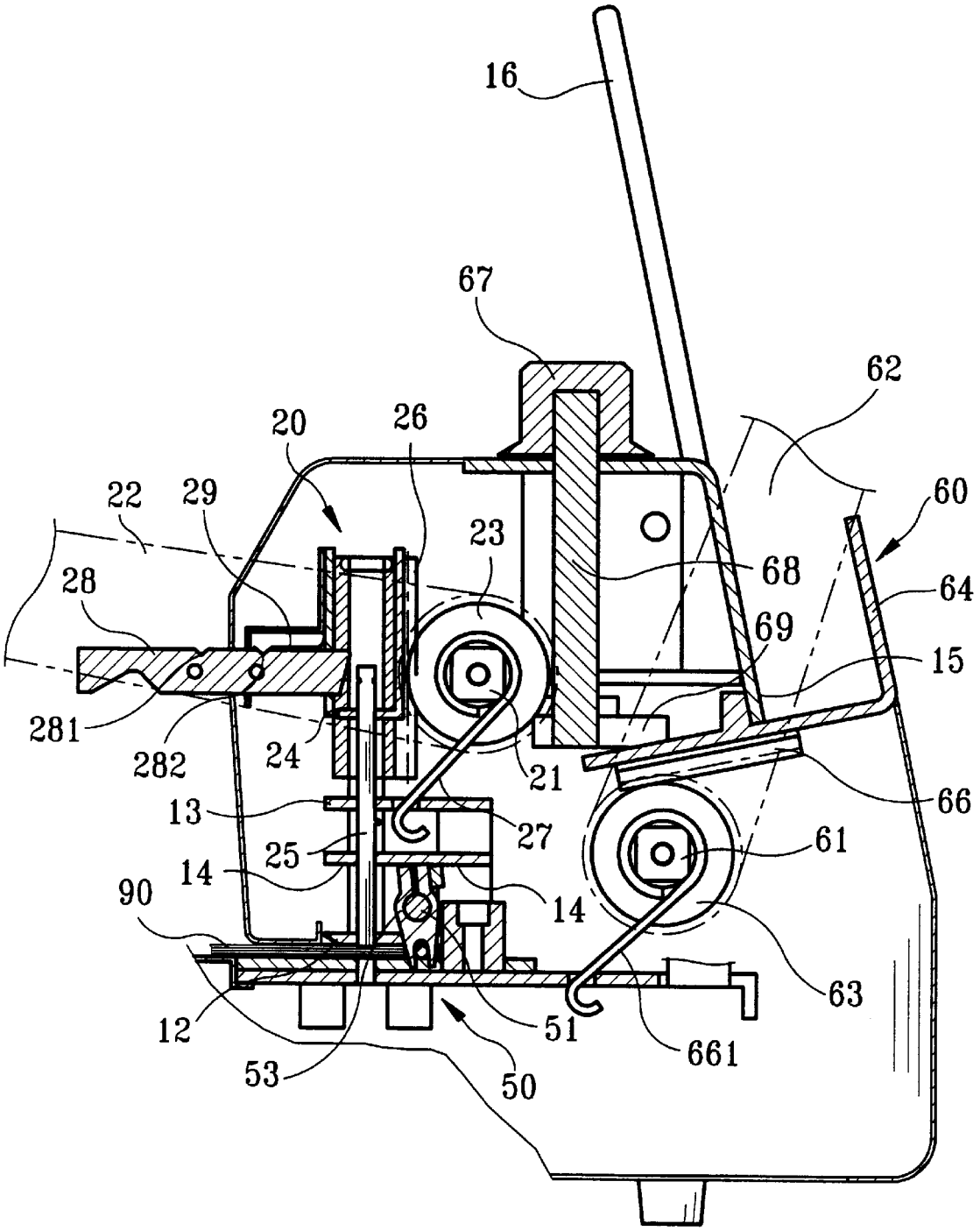

3. Punching:

Referring to FIGS. 1 to 3, the hole-punching device 20 includes a first rotating axle 21 rotatably connected between two sides of the casing 10. A first rocker arm 22 is secured to an end of the first rotating axle 21 that extends beyond the casing 10 for manual operation. At least one first transmission gear 23 is secured on the first rotating axle 21. Said at least one gear 23 meshes with at least one first rack 26 that is secured on a cutter seat 24 carrying a plurality of cutters 25 thereon. The first rotating axle 21 further includes at least one first returning spring 27 that provides a spring force for returning the first rotating axle 21 to its initial position. The cutter seat 24 includes a plurality of divided compartments. The cutters 25 may move freely in the compartments, respectively. The cutters 25 may move further downwardly through a row of holes (not labeled) defined in fixed plates 12, 13, and 14 secured to the casing 10, thereby keeping the cutters 25 moving rectilinearly. Thus, the cutters 25 will not deviate even if external force is involved. Mounted to the cutter seat 24 above the cutters 25 are a plurality of slidable shields 28 each having two positioning recesses 281 and 282. One of the recesses 281 and 282 cooperates with a positioning spring 29 to make the slidable shield 28 be positioned in either an inert position or an extraction position. Referring to FIGS. 6A and 6B, when the slidable shield 28 is in the insert position, the slidable shield 28 abuts against a top of an associated cutter 25 such that the cutter 25 cannot move upwardly. In this status, the user may turn the first rocker arm 22 to make the first rotating axle 21 rotate. The cutter seat 24 moves along a vertical direction via transmission of the first transmission gear 23 and the first rack 26. The cutters 25 with the tops stopped by the slidable shields 28 move downwardly along with the cutter seat 24 and thus punch a row of equidistant holes in the stack of papers 90 located between the fixed plate 12 and a base of the casing 10. Referring to FIG. 6C, the slidable shield 28 disengages from the associated cutter 25 when the former is in the extraction position, such that the cutter 25 moves upwardly relative to the cutter seat 24 when the cutter 25 touches the stack of papers 90 and is thus stopped by a resistance. Thus, the cutter 25 cannot perform the punching function in the stack of papers 90.

By means of provision of the slidable shields 28, any cutter 25 may be independently selected to optionally proceed with or not to proceed with punching in the papers. This avoids defective products as a result of punching incomplete holes in the edges of the stack of papers. In addition, the distance between each two adjacent holes to be punched can be adjusted according to the size of a special volume or the user need. In addition, as can be seen from FIG. 2, punch-hole position reference rulers 17 and 18 are respectively adhered to the base of the casing 10 for placing the stack of papers 90 and to the casing 10 in an area above the slidable shields 28. This allows the user to predict whether incomplete holes will be punched by viewing the punch-hole position reference ruler 18. If the answer is affirmative, the slidable shield 28 corresponding to the numbering on the other punch-hole position reference ruler 17 is drawn out to disable the associated cutter 25, thereby preventing generation of an incomplete hole.

As can be seen from FIG. 3, the cutters 25 are not of identical length, instead, the cutters 25 are designed to have gradually increased length in sequence to reduce the resistance to the cutters 25 during punching of the stack of papers 90.

Figure 7:
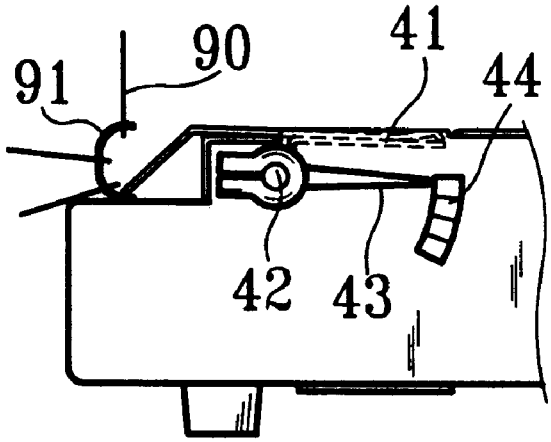
FIG. 7 is a view similar to FIG. 4A, wherein the resilient load-on plate is used to assist in extending of open-ended the helical coil through the punched holes of the papers.

4. Extending helical coils through the punched holes:

After punching, as can be seen from FIG. 7, the user may use the load-on plate 40 to retain a plurality of helical coils 91 in an upright status between the load-on plate 40 and the paper-loading platform 45. This helps the user make the punched papers 90 be extended by the open ended helical coils 91.

Figure 8A:
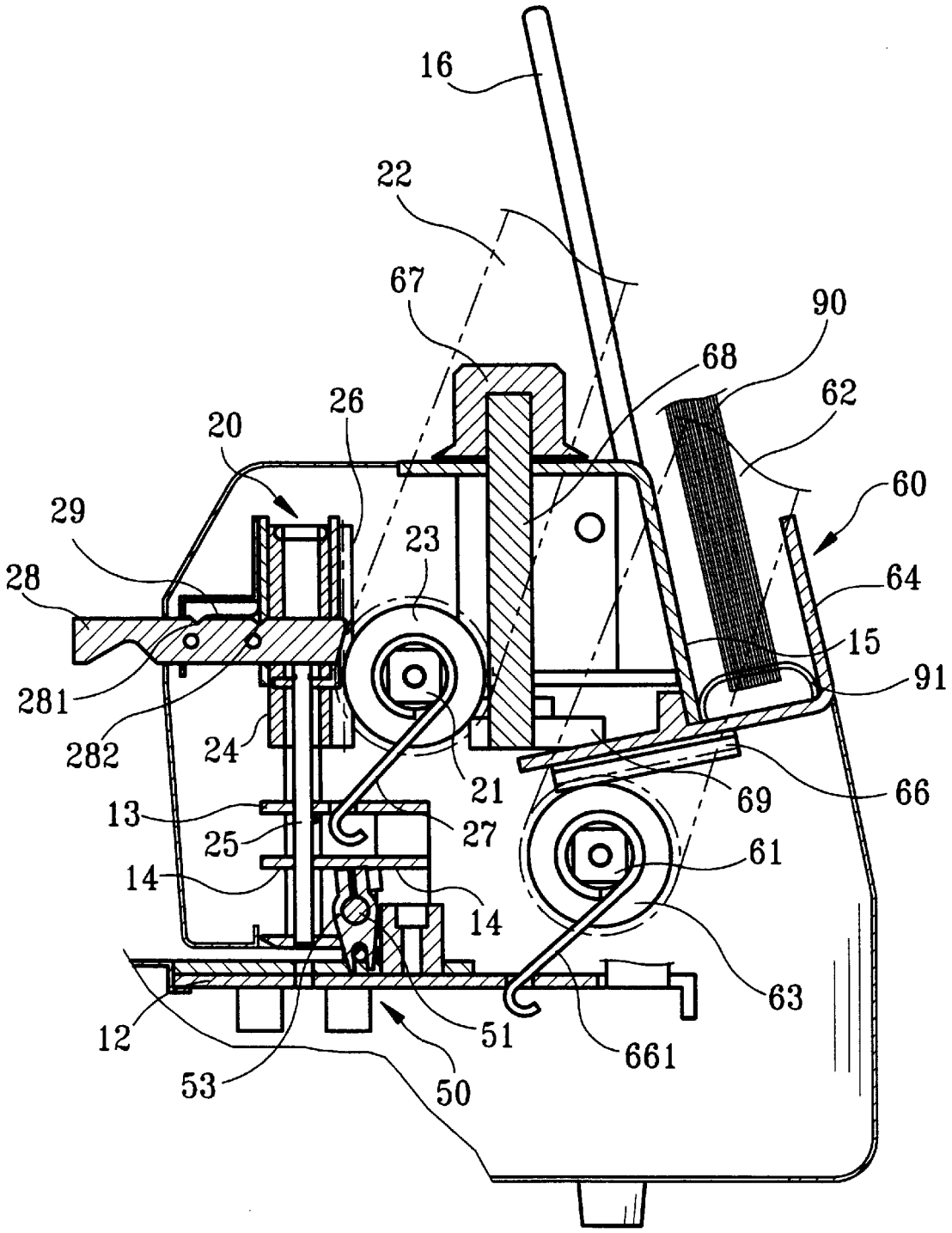
FIG. 8A is a sectional view of the hole-punching and binding apparatus, wherein the helical coils are to be extended through the punched holes of the papers.
Figure 8B:
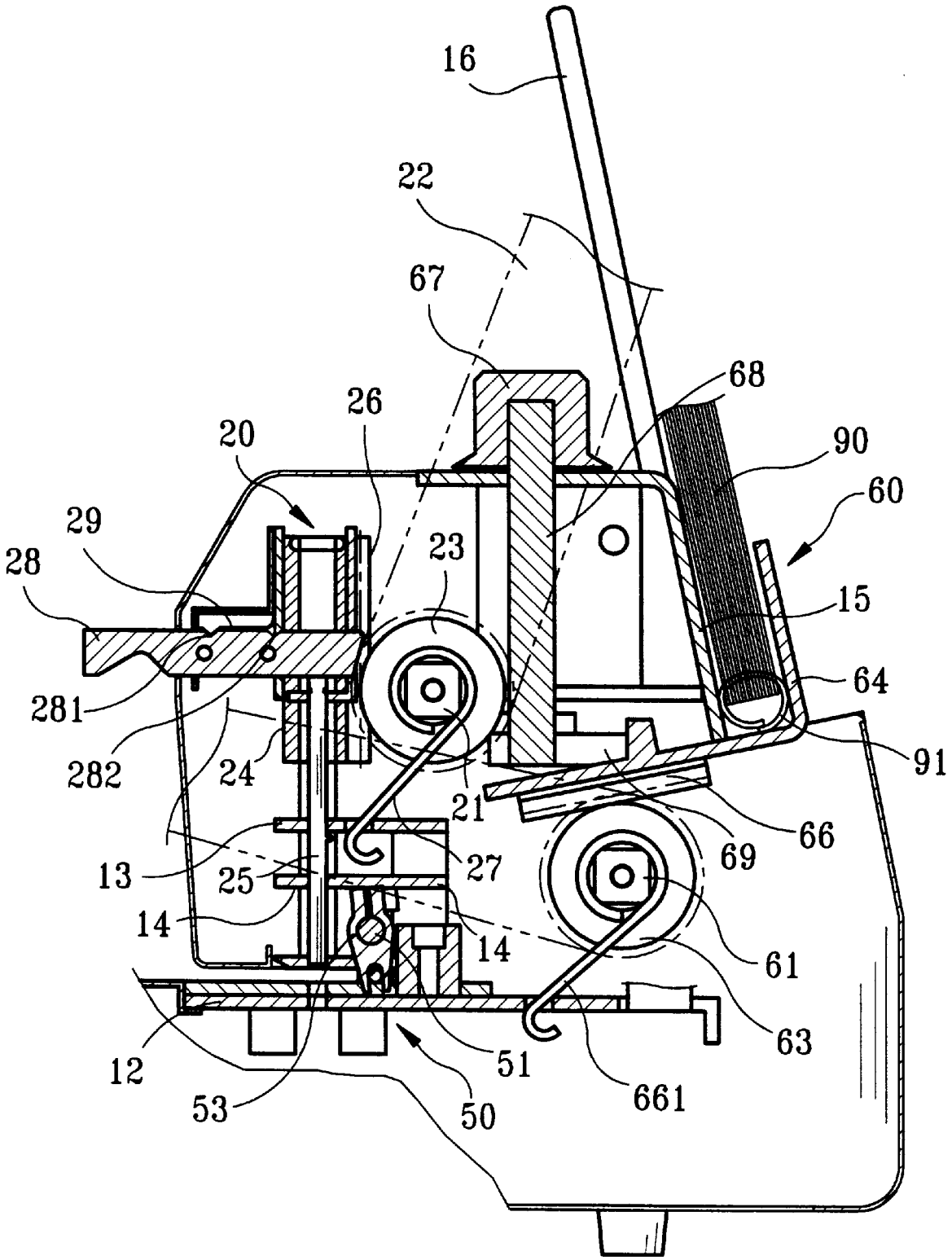
FIG. 8B is a view similar to FIG. 8A, wherein the helical coils have been extended through the punched holes of the papers.

5. Closing the open ended helical coils to closed ended helical coils:

Referring to FIGS. 1 and 2, the coil-closing device 60 for closing the open ended helical coils 91 to closed ended helical coils 91 includes a second rotating axle 61 rotatably connected between two sides of the casing 10. A second rocker arm 62 is secured to an end of the second rotating axle 61 that extends beyond the casing 10 for manual operation. At least one second transmission gear 63 is secured on the second rotating axle 61. Said at least one gear 63 meshes with at least one second rack 66 that is secured on an L-shaped press plate 64. The second rotating axle 61 further includes a second returning spring 661 to provide a spring force for returning the second rotating axle 61 to its initial position. Referring to FIG. 8A, the punched papers 90 extended by the open-ended helical coils 91 are placed between the L-shaped press plate 64 and a fixed plate 15 that forms a part of the casing 10. The weight of the stack of papers 90 is supported by a telescopic support 16. In this status, as shown in FIG. 8B, the user may turn the second rocker arm 62 to overcome the spring force of the second returning spring 661, thereby making the second rotating axle 61 to rotate along with the second rocker arm 62. The L-shaped press plate 64 moves along a horizontal direction via transmission of the second transmission gear 63 and the second rack 66. As a result, the L-shaped press plate 64 moves toward the fixing plate 15 and thus closes the open ended helical coils 91 to closed ended helical coils 91, as shown in FIG. 9B. Thus, the stack of punched papers 90 are extended through by the closed ended helical coils 91 and will not scatter accordingly.

The travel of the L-shaped press plate 64 is stopped by an adjustable braking cam 60 that engages with a projection 65 on the press plate 64. The travel of the press plate 64 is adjusted by means of turning an adjusting knob 67 to rotate the braking cam 69 through an angle via transmission of a spindle 68, thereby allowing the press plate 64 to close helical coils of different open angles. Referring to FIG. 2, an open angle scale 19 is adhered to the casing 10 at an appropriate position to allow the user to measure the open angle of the open ended helical coils 91 before the closing procedure. The user may refer to an open angle reference scale 671 adhered to a circumference of the adjusting knob 67 such that the user may turn the adjusting knob 67 to rotate the braking cam 69 to an angular position corresponding to the open angle of the helical coils.

Figure 9:
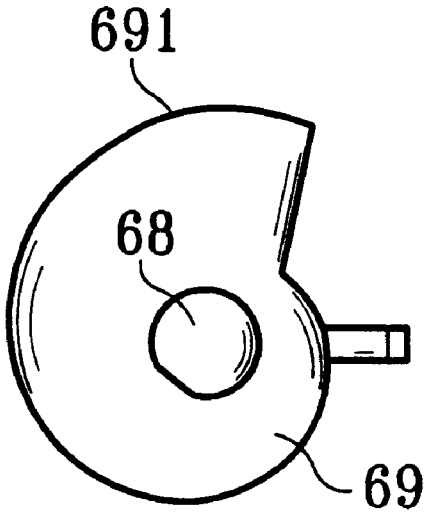
FIG. 9 is a plan view of a braking cam of the coil-closing device of the hole-punching and binding apparatus.

The outline of the braking cam 69 is shown in FIG. 9. The braking cam 69 includes an outwardly expanding helical outline 691 to provide a stepless adjustment in the travel of the press plate 64.

According to the above description, it is appreciated that the hole-punching and binding apparatus in accordance with the present invention includes the following advantages when compared with the conventional hole-punching and binding devices:

1. The hole-punching and binding apparatus is simple in structure to lower the manufacture cost and improve the precision of hole punching and binding.
2. The axles and the transmission members need not to be detached when replacing the cutters to thereby provide convenience to maintenance.
3. The helical coil can be made of metal or other material, not limited to plastic material. The hole-punching and binding apparatus has a wider application range and better utility, as it is not limited to the use of plastic coil in the prior art.
4. The thickness of the stack of papers to be bound can be measured precisely.

In addition, the margin of the holes to be punched are automatically adjusted in response to the thickness of the stack of papers, thereby assuring that each sheet of paper is turnable after the coil is extended through the holes.

5. Any cutter may be independently selected to optionally proceed with or not to proceed with punching, thereby preventing generation of defective products with incomplete holes punched in the edges of the papers. The distance between each two adjacent holes to be punched may be adjusted according to the size of a special volume or the user need.

6. The open angle of the open ends of the helical coils before closing can be measured to thereby adjust the travel of the press plate that precisely closes the open ends of the helical coils.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A hole-punching and binding apparatus for papers, comprising:

a casing;

a hole-punching device drivable to move along a vertical direction, the hole-punching device including a cutter seat carrying thereon a plurality of cutters that are equidistantly spaced in a row to punch a row of holes in a stack of papers, the cutter seat being movable in a hole-punching travel, the hole-punching device including a row of compartments, each said cutter being freely movable in the compartments, respectively, a slidable shield being mounted above each said cutter for optionally stopping an associated said cutter to make the associated cutter to move along with the cutter seat during the hole-punching travel of the cutter seat;

a resilient load-on plate acting as a lever, the resilient load-on plate being adapted to retain each of a plurality of open ended helical coils to extend the open ended helical coils through punched holes in the stack of papers, the resilient load-on plate including an end tightly bearing against the stack of papers, and including a paper thickness scale to indicate the thickness of the stack of papers;

a margin-adjusting device including a paper depth-fixing plate that abut against aligned edges of the stack of paper to adjust an entering depth of the stack of papers into the hole-punching device, such that the hole to be punched by each said cutter has a pre-set margin to the aligned edges of the stack of paper;

a coil-closing device drivable to move along a horizontal direction, a fixed plate being secured to the casing, the stack of papers that have been punched being placed between the coil-closing device and the fixed plate so as to be pressed to close an open end of each said open ended helical coil, the coil-closing device further including a projection; and an adjustable baking cam for adjusting a travel of the coil-closing device, the coil-closing device is stopped when the projection of the coil-closing device contacts with the braking cam.

2. The hole-punching and binding apparatus for papers as claimed in claim 1, wherein the resilient load-on plate includes a mediate section pivoted to a pivotal axle by means of at least one torsion spring such that the resilient load-on place acts as a lever about the pivotal axle that acts as a fulcrum, the pivotal axle including an end that extends beyond the casing, and a thickness pointer being secured to the resilient load-on plate for indicating the thickness of the stack of papers.

3. The hole-punching and binding apparatus for papers as claimed in claim 1, wherein the margin-adjusting device includes a control knob, an axle rod connected to the control knob to rotate therewith, and at least one arm secured to the axle rod for moving the paper depth-retaining device along the horizontal direction.

4. The hole-punching and binding apparatus for papers as claimed in claim 3, wherein the axle rod includes a first end around which a compression spring is mounted and a second end to which a positioning block is mounted, the casing including a plurality of positioning holes, the positioning block being retained in one of the positioning holes by the compression spring.

5. The hole-punching and binding apparatus for papers as claimed in claim 1, wherein the cutter seat includes at least one first rack mounted thereon, and wherein the hole-punching device includes a first rotating axle rotatably mounted to the casing, the first rotating axle including an end, a first rocker arm being secured to the end of the first rotating axle for manual operation, the first rotating axle further including at least one first transmission gear secured thereon to rotate therewith and meshed with said at least one first rack, the first rotating axle further including a first returning spring for returning the first rotating axle to its initial position.

6. The hole-punching and binding apparatus for papers as claimed in claim 1, wherein each said slidable shield includes two positioning recesses, and further comprising a positioning spring engaged with one of the positioning recesses for moving the slidable shield between an insert position that stops the associated cutter and an extraction position that disengages from the associated cutter.

7. The hole-punching and binding apparatus for papers as claimed in claim 1, wherein each of the casing and said slidable shields includes a punch-hole position reference scale to allow a user to predict the position of the hole to be punched by vision.

8. The hole-punching and binding apparatus for papers as claimed in claim 1, wherein the cutters are not of identical length, the cutters are designed to have gradually increased length in sequence.

9. The hole-punching and binding apparatus for papers as claimed in claim 1, wherein the coil-closing device includes an L-shaped press plate and a second rotating axle rotatably mounted to the casing, the second rotating axle including an end, a second rocker arm being secured to the end of the second rotating axle for manual operation, the L-shaped press plate including at least one second rack mounted thereon, the second rotating axle further including at least one second transmission gear secured thereon to rotate therewith and meshed with said at least one second rack, the second rotating axle further including a first returning spring for returning the second rotating axle to its initial position.

10. The hole-punching and binding apparatus for papers as claimed in claim 1, further comprising an open angle scale for measuring the open angle of the open ends of the helical coils.

11. The hole-punching and binding apparatus for papers as claimed in claim 1, wherein the braking cam includes an outwardly expanding helical outline.

* * * * *